United States Patent [19]

Goodwin et al.

[11] Patent Number: 5,072,788

[45] Date of Patent: Dec. 17, 1991

[54] CATALYTIC CONVERTER TUBE LOCATOR AND CLEANER

[76] Inventors: Duane N. Goodwin, 3 S. Frontage Rd., Goldhill, Oreg. 97525; Craig D. Goodwin, 110 Savage Circle Rd., Grants Pass, Oreg. 97527

[21] Appl. No.: 648,139

[22] Filed: Jan. 30, 1991

[51] Int. Cl.[5] ..... F28G 1/02

[52] U.S. Cl. ..... 165/95; 165/76; 15/104.16; 15/104.2; 141/346; 141/352

[58] Field of Search ..... 165/11.2, 95, 76; 15/104.16, 104.2; 141/251, 284, 346, 347, 351, 352, 360, 361

[56] References Cited

U.S. PATENT DOCUMENTS

| | | | |
|---|---|---|---|
| 2,746,535 | 5/1956 | Barroso | 15/104.16 X |
| 2,882,022 | 4/1959 | Greathouse et al. | 15/104.16 X |
| 3,280,415 | 10/1966 | Moore et al. | 15/104.16 X |
| 4,373,855 | 2/1983 | Lebouc | 165/76 X |
| 4,691,723 | 9/1987 | Mierswa et al. | 134/167 C |

FOREIGN PATENT DOCUMENTS

| | | | |
|---|---|---|---|
| 2563331 | 10/1985 | France | 165/95 |

*Primary Examiner*—Allen J. Flanigan

*Attorney, Agent, or Firm*—Fleit, Jacobson, Cohn, Price, Holman & Stern

[57] ABSTRACT

An elongated track assembly is provided for disposition outwardly of and paralleling one pair of corresponding ends of a row of tubes and the track assembly includes a support mounted therefrom for movement along the track assembly. An elongated and longitudinally projectable and retractable pilot member is mounted from the support as well as elongated and longitudinally projectable and retractable tool which parallels the pilot member. Power structure is provided operative to power project and power retract the tool relative to the support and manually operable structure is provided for manually projecting and retracting the pilot member relative to the support. Control structure is provided for the power structure operatively associated with the manually operable structure for projecting and retracting the pilot structure for actuating the power structure to project the tool responsive to projection of the pilot structure from a retracted position thereof past a first projected position to a second further projected position and for actuating the power structure to retract the tool responsive to partial retraction of the pilot structure from the second projected position thereof to the first projected position thereof.

12 Claims, 2 Drawing Sheets

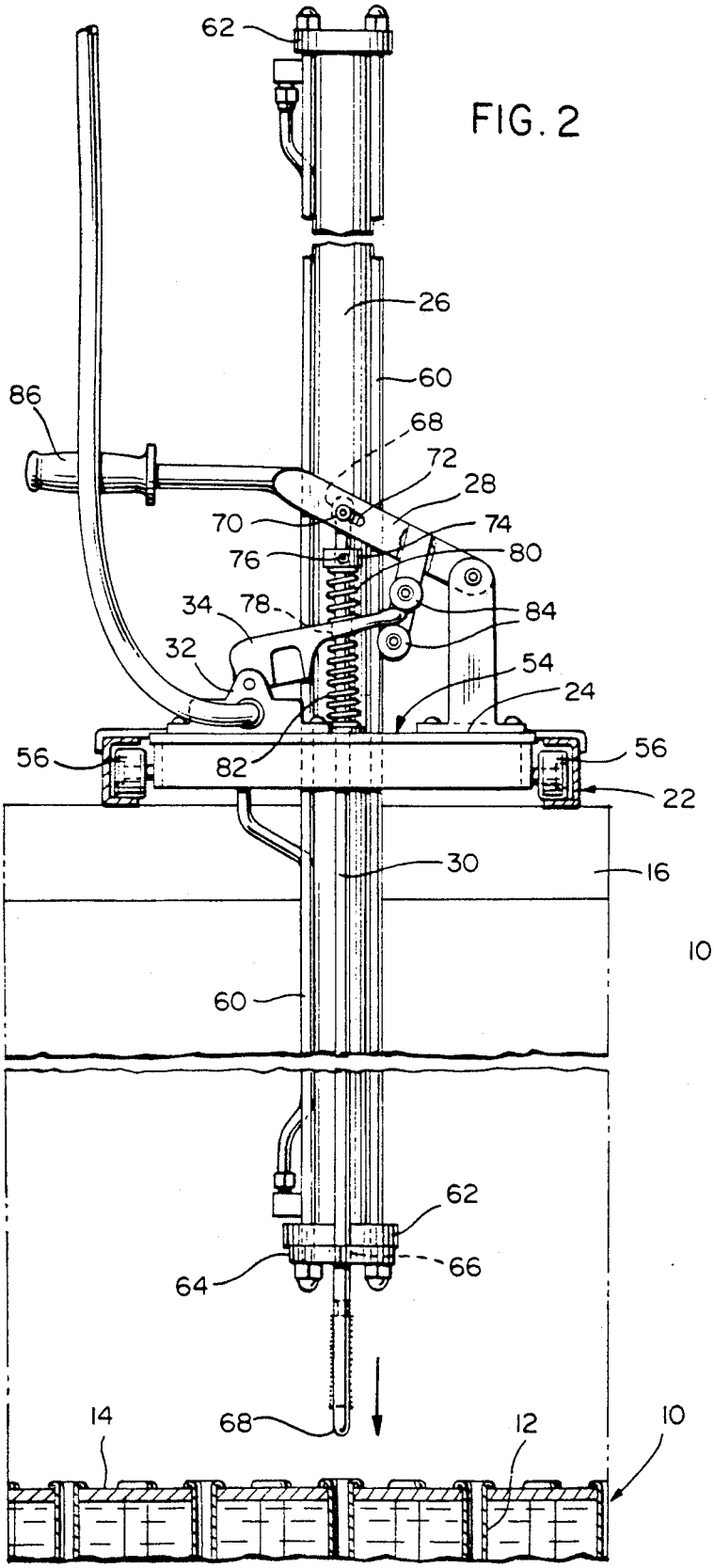
FIG. 2
FIG. 3
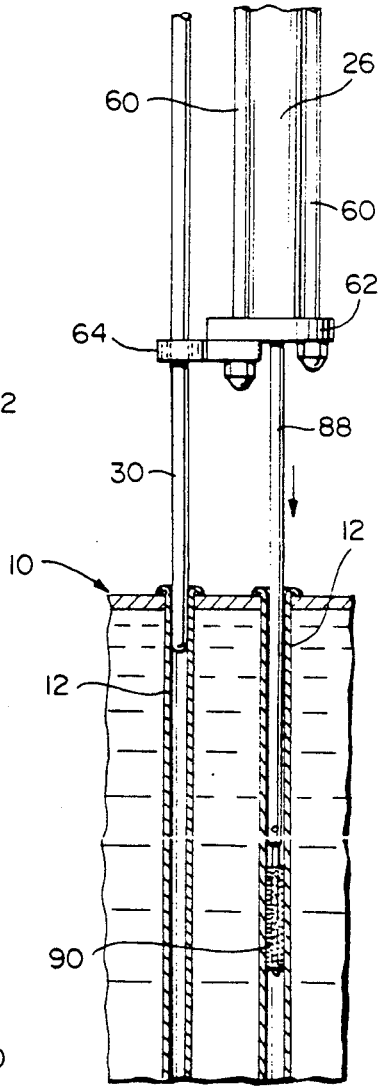

CATALYTIC CONVERTER TUBE LOCATOR AND CLEANER

BACKGROUND OF THE INVENTION

1. Field of the Invention

This invention relates to an apparatus which may be used efficiently to clean the tubes (up to 14,000) of a formaldehyde converter and wherein the brush or other cleaning head utilized to clean the tubes is power projected into and power retracted from each of the converter tubes upon proper indexing in position therewith through the utilization of a pilot member projectable into and retractable from a tube adjacent to the tube to be cleaned, the pilot member determining the proper registry of the cleaning head with the tube to be cleaned and the projection of the pilot member into an adjacent tube being operable to automatically actuate power structure to drive the cleaning head into and through the tube to be cleaned and partial withdrawal of the pilot member from the adjacent tube being operable to automatically power the cleaning head from the tube being cleaned.

2. Description of Related Art

Various different forms of tube cleaning mechanisms heretofore have been provided such as those disclosed in U.S. Pat. Nos. 582,953, 1,441,431, 1,694,371, 1,957,466, 2,795,391, 3,886,694, 4,225,362 and 4,367,790.

However, these previously known forms of cleaning devices do not include the overall combination incorporated in the instant invention wherein a pilot member is projected into a first tube for proper registry of a power driven cleaning head with a second tube to be cleaned and wherein projection of the pilot member a predetermined distance into the first tube automatically actuates the power mechanism for power projecting the cleaning head through the second tube.

SUMMARY OF THE INVENTION

The converter tube locator and cleaner of the instant invention has been specifically designed to provide a means whereby a power projected and retracted cleaning apparatus may be properly aligned with a converter tube to be cleaned and actuated for power projection and power retraction only upon proper registry thereof with the tube to be cleaned.

The main object of this invention is to provide an apparatus by which a power driven projectable and retractable cleaning head may be correctly aligned or indexed relative to the end of a tube into which the cleaning head is to be projected.

Another object of this invention, in accordance with the immediately preceding object, is to provide a tube cleaning apparatus for cleaning a plurality of laterally adjacent tubes and wherein a pilot member is initially projected into a first tube end for properly locating or indexing a power driven projectable and retractable cleaning head relative to an adjacent tube to be cleaned.

Still another important object of this invention, in accordance with the immediately preceding object, is to provide a control for projecting the pilot member into the first tube in a manner such that projection of the pilot member into the first tube a predetermined amount will automatically actuate the power mechanism for power driving the cleaning head into an adjacent tube to be cleaned and subsequent outward shifting of the pilot member relative to the first tube will actuate the power mechanism for withdrawing the cleaning head from the tube being cleaned.

A further object of this invention is to provide an apparatus which may be adaptable for use in conjunction with multiple tube converters of various different manufacture.

Yet another object of this invention is to provide a tube cleaning apparatus which may be utilized to clean tubes of other vessels than converter vessels.

A final object of this invention to be specifically enumerated herein is to provide a catalytic converter tube locator and cleaner in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 2 is an enlarged fragmentary vertical sectional view taken substantially upon the plane indicator by the section line 2—2 of FIG. 1;

FIG. 3 is a fragmentary enlarged vertical sectional view illustrating the manner in which the pilot member of the cleaner is first downwardly inserted into a first tube of the converter in order to properly position the powered tube cleaning head in registry with an adjacent tube into which the cleaning head is to be downwardly received;

DETAILED DESCRIPTION OF THE INVENTION

Figure 1:
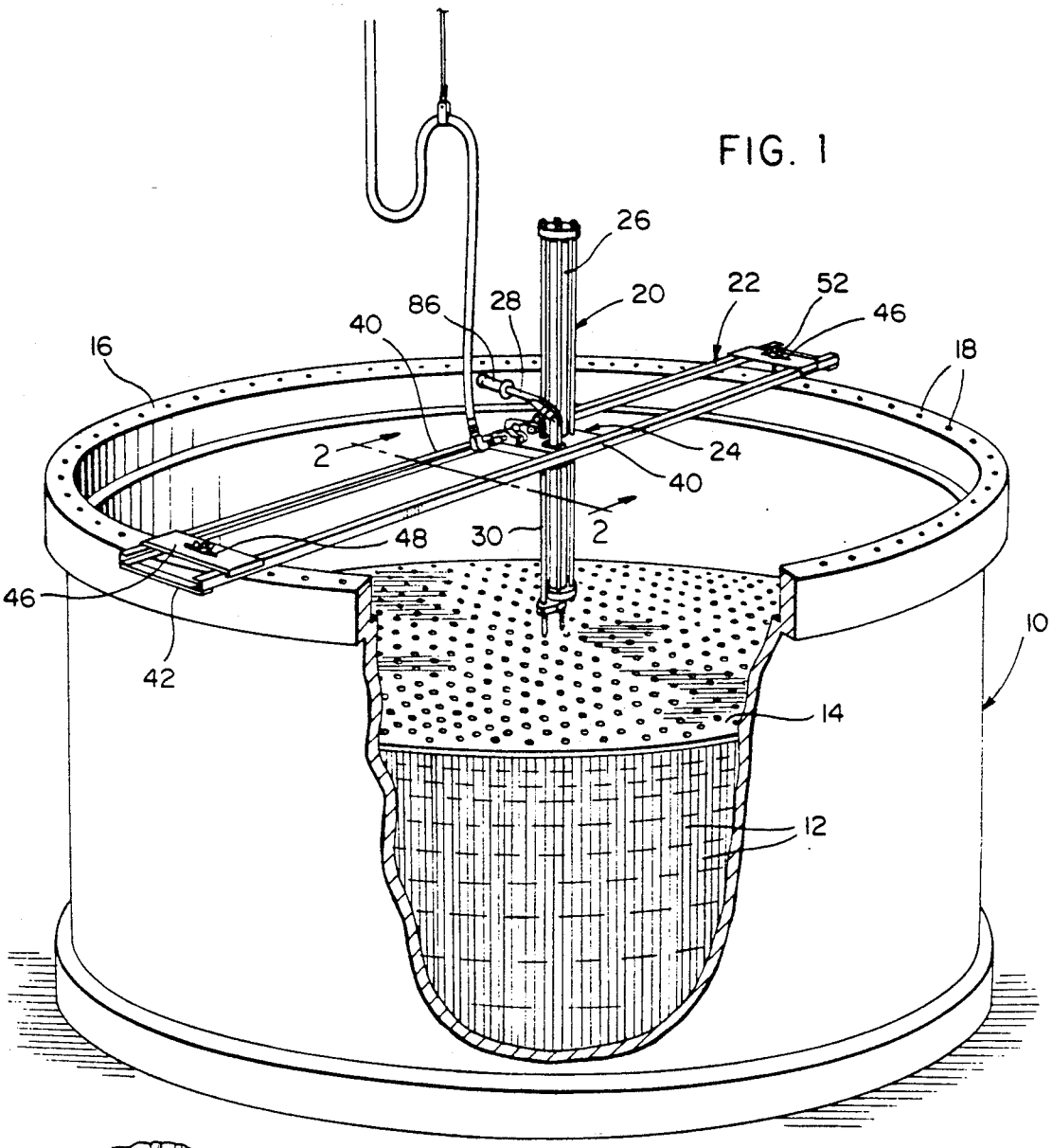
FIG. 1 is a perspective view of a typical formaldehyde converter with an adjacent wall portion thereof being broken away and illustrated in section and with the tube locator and cleaner of the instant invention operatively associated with the open upper side or end of the converter.

Referring now more specifically to the drawings the numeral 10 generally designates a typical form of formaldehyde converter containing a plurality of vertical converter tubes in 12 including upper ends opening upwardly through a top plate 14. The upper side or top of the converter 10 includes a reinforced peripheral rim 16 having threaded apertures 18 spaced peripherally there about for attaching a top wall or closure (not shown) over the upper end of the converter 10.

After usage of the converter 10 for an indeterminate amount of time it becomes necessary to clean the interiors of the tubes 12. Cleaning the interiors of the tubes of a formaldehyde converter such as the converter 10 can be very time consuming, particularly since the converter can contain up to 14,000 individual tubes.

The converter tube locator and cleaner of the instant invention is referred to in general by the reference numeral 20 and includes an elongated track assembly referred to in general by the reference numeral 22, a dolly or follower referred to in general by the reference numeral 24 mounted upon the track assembly 22 for movement therealong and a double acting fluid cylinder 26 mounted from the follower 24. Also, the follower 24 mounts a pivoted control lever 28, a slidable pilot rod 30 and a fluid control valve 32 therefrom, the control valve 32 including a pivoted operating lever 34 with which the control lever 28 is operably connected and the control lever 28 including an operative connection with the pilot rod 30 in a manner to be hereinafter more fully set forth.

Figure 5:
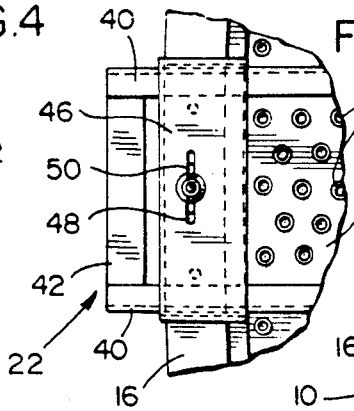
FIG. 5 is a fragmentary top plan view illustrating the manner in which one end of the track assembly of the cleaner is releasably anchored in position relative to one side portion of the open upper side of the catalytic converter.
Figure 6:
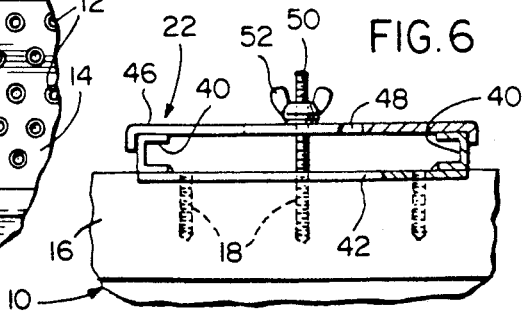
FIG. 6 is a side elevational view on an enlarged scale illustrating the assemblage shown in FIG. 5 from the left side thereof and with portions of the track assembly being broken away and illustrated in vertical section.

With reference now more specifically to FIGS. 1, 5 and 6, it may be seen that the track assembly 22 includes a pair of opposing C-shaped channel members 40 which parallel each other and include corresponding opposite ends interconnected by connecting straps 42. In addition, each pair of corresponding ends of the channel members 40 is bridged by a downwardly opening channel member clamp plate 46 having a longitudinal slot 48 formed therein centrally intermediate its opposite ends. A clamp-screw 50 passes downwardly through each slot 48 and is threadedly engaged in an associated aperture 18, each clamp screw 50 having a wing nut 52 threaded thereon above the corresponding clamp plate 46. In this manner, the track assembly 22 may be rigidly supported from the open end or side of the catalytic converter 10.

The fluid cylinder 26 (air or hydraulic) is rigidly mounted through the deck plate 54 of the dolly or follower 24 and the latter includes pairs of opposite side support wheels 56 journaled therefrom for guided movement of the dolly or follower 24 along the track assembly 22.

With both ends of the track assembly 22 supported from the diametrically opposite portions of the rim 16, the dolly or follower 24 is mounted for movement along a determined path across the upper end or side of the casing 10. The track assembly 22 may be slightly laterally adjusted relative to the clamp screws 50 by means of the slots 48 formed in the clamp plates 46.

The tubes 12 are disposed in rows of tubes extending transversely of the converter 10 and the track assembly 22 parallels a selected row of tubes to be cleaned.

The cylinder 26 includes exterior rods 60 which extend between and fasten end plates 62 to the upper and lower ends of the cylinder 26 and one pair of rods 60 also supports a guide plate 64 from the lower end of the cylinder 26, the guide plate 64 including a bore 64 formed therethrough through which the lower end of the rod 30 is guidingly received, the lower terminal end of the rod 30 being tapered as at 68. The guide rod 30 also is guidingly received through the plate 54 and equipped with an eye 68 on its upper end through which a pivot and slide fastener 70 is secured, the fastener 70 also being slidably received through a longitudinal slot 72 formed in the longitudinal mid-portion of the control lever 28.

The rod 30 has an adjustable stop sleeve 74 secured thereon in adjusted position by a set screw 76 and the rod 30 passes through an opening 78 provided therefore in the operating lever 34 with an upper compression spring 80 disposed about the rod 30 between the sleeve or collar 74 and the operating lever 34 and a lower compression spring 82 disposed about the rod 30 between the operating lever 34 and the plate 54. The springs 80 and 82 tend to maintain the operating lever 34 in its center or neutral position and the free end of the operating lever 34 is received between a pair of journaled rollers 84 carried by the control lever 28 whereby downward and upward movement of the free end 86 of the control lever 28 will cause downward and upward movement, respectively, of the free end of the operating lever 34 disposed between the rollers 84.

In operation, the track assembly 82 initially is mounted from the rim 16 of the converter 10 such that the center line of the cylinder 26 will traverse a path containing the center lines of one row of tubes 12. The cylinder 26 includes an interior piston to one end of which a force rod 88 is mounted, the rod 88 projecting outwardly from the lower end of the cylinder 26. The lower end of the rod 88 has a suitable cleaning head or brush 90 mounted thereon and the rods 30 and 88 are laterally spaced apart a distance equal to the spacing between adjacent tubes 12 in each row of tubes.

Figure 4:
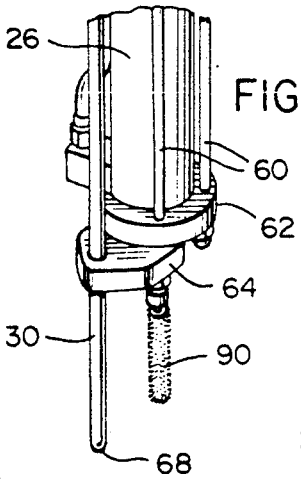
FIG. 4 is a fragmentary perspective view of the lower end of the power cylinder for projecting and retracting the cleaning head and also illustrating the guide supported therefrom for the pilot member of the cleaner.

When the rods 30 and 88 are fully retracted, they are in the positions thereof illustrated in FIGS. 1, 2 and 4 with the lower end of the pilot rod 30 projecting at least slightly below the lower end of the cleaning head or brush 90.

Assuming the control lever 28 to be in the neutral position thereof, initial downward movement of the free end 86 of the control lever 28 will cause downward displacement of the pilot rod 30 until such time as the pilot rod 30 enters into the upper end of a tube 12 to a position slightly above the position thereof illustrated in FIG. 3. When the pilot rod 30 enters the upper end of the left hand tube 12 illustrated in FIG. 3, the force rod 88 is automatically aligned with the right hand tube 12 and slightly further downward movement of the free end 86 of the control lever 28 further lowers the pilot rod 30 into the left hand tube 12 to the position thereof illustrated in FIG. 3 and opens the control valve 32 such that fluid under pressure is admitted into the upper end of the cylinder 26 and vented from the lower end of the cylinder 26. The fluid pressure then forces the force rod 80 and the cleaning head or brush 90 down into the right hand tube 12 illustrated in FIG. 3. The total stroke of the cylinder 26 will be determined by the length of the tubes 12 and the cylinder 26 may exert a downward force on the rod 88 of approximately 400 pounds, which pressure is sufficient to force the cleaning head or brush 90 through the right hand tube 12 illustrated in FIG. 3.

Upon completion of the downward stroke of the force rod 88, the free end 86 of the control lever 28 is swung back up toward but short of the position thereof illustrated in FIG. 2. This will result in the operating lever 34 being moved to a position whereby the control valve 32 will reverse operation of the cylinder 26 and cause the force rod 88 and cleaning head or brush 90 to be withdrawn from the right hand tube 12 illustrated in FIG. 3. Then, if it is necessary to again extend the cleaning head or brush 90 downward through the right hand tube 12 illustrated in FIG. 3, the free end 86 of the control lever 28 is again depressed to cause the force rod 88 and the cleaning head or brush 90 to again be forced downwardly through the right hand tube illustrated in FIG. 3. This process may be repeated as many times as desired.

When the cleaning operation of the right hand tube 12 illustrated in FIG. 3 is completed, the free end 86 of the control lever 28 may be returned to the neutral position thereof illustrated in FIG. 2, during which movement the force rod 88 and cleaning head or brush 90 are upwardly withdrawn from the right hand tube 12 illustrated in FIG. 3 and the pilot rod 30 thereafter will be fully upwardly withdrawn from the left hand tube 12 illustrated in FIG. 3. Then, the dolly or follower 24 may be shifted along the track assembly 22 to align the pilot rod 30 with the right hand tube 12 illustrated in FIG. 3 and the control lever 28 again may be actuated to allow the force rod and cleaning head or brush to be projected down into the next tube 12 (not shown) to the right of the right hand tube 12 illustrated in FIG. 3.

This procedure is of course repeated along each row of tubes 12 of the converter 10 until all tubes 12 thereof have been cleaned. However, as each row of tubes 12 has been cleaned, the track assembly 22 must be repositioned in aligned with the next row of tubes 12 to be cleaned, which alignment process is carried out by use of the pilot rod 30.

The important aspect of the instant invention is that the cylinder 26, capable of exerting perhaps 400 pounds downward force on the force rod 88 and cleaning head or brush 90, cannot be actuated to downwardly thrust the force rod 88 until the pilot rod 30 has been projected downwardly into an adjacent tube 12. Thus, as long as the track assembly 22 is properly aligned with the row of tubes to be cleaned, the force rod 88 and cleaning head or brush 90 always will be properly aligned with a tube 12 to be cleaned when the cylinder 26 is actuated to apply a downward thrust on the force rod 88.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is as follows:

1. In combination, a vessel including at least one open side a plurality of tubes ends opening outwardly of said one side and with said tubes arranged in tube sets and the tube ends of each set of tubes being equally laterally spaced relative to each other in a predetermined path, a support mounted from said vessel and including track means paralleling said path, follower means mounted on said track means for movement therealong, said follower means including projectable and retractable pilot means mounted from said follower and projectable into and retractable from successive tube ends along said path upon incremental shifting of said follower means along said track means, said follower means further including projectable and retractable tube conditioning means registered with and projectable into and retractable from a tube end in said path spaced from the tube end into which said pilot means is projectable and retractable when said follower means is in predetermined position on said track means, whereby said pilot means functions as indexing means when projected into a first tube end in said path to determine and maintain an indexed position of said follower on said track relative to a second tube end in said path with which said tube conditioning means is registered for receiving said tube conditioning means thereinto.

2. The combination of claim 1 wherein said follower means includes power means for powered projection and retraction of said tube conditioning means relative to said follower and into and from said second tube end.

3. The combination of claim 2 wherein said power means includes a control therefore operatively associated with said pilot means for automatic operation of said power means upon projection of said pilot means sufficiently to be received a predetermined distance in said first tube end.

4. The combination of claim 3 wherein said power means includes means for powered retraction of said tube conditioning means.

5. The combination of claim 1 wherein said track means includes a pair of parallel track members including corresponding opposite ends, means rigidly interconnecting each pair of corresponding opposite ends, the opposite ends of said track means each including a clamp member shiftable longitudinally of said track means and a clamp screw received through a slot formed in the corresponding clamp member with each slot extending lengthwise in a path extending transversely between said track members.

6. The combination of claim 1 wherein said power means comprises a double action fluid cylinder.

7. The combination of claim 1 wherein said track means includes a pair of parallel track members including corresponding opposite ends, means rigidly interconnecting each pair of corresponding opposite ends, the opposite ends of said track means each including a clamp member shiftable longitudinally of said track means and a clamp screw received through a slot formed in the corresponding clamp member with each slot extending lengthwise in a path extending transversely between said track members, said track members including opposing C-shaped channel members, said follower means including a dolly provided with pairs of opposite side wheels rollingly received in said C-shaped channel members.

8. The combination of claim 1 wherein said means includes power means for powered projection of said tube conditioning means relative to said support and into said second tube end.

9. The combination of claim 8 wherein said power means includes a control therefore operatively associated with said pilot means for automatic actuation of said power means to project said tube conditioning means upon projection of said pilot means sufficiently to be received a predetermined distance in said first tube.

10. The combination of claim 9 wherein said power means includes means for powered retraction of said tube conditioning means.

11. In combination, a support, an elongated and longitudinally projectable and retractable pilot means mounted from said support, an elongated and longitudinally projectable and retractable tool mounted from said support and substantially paralleling said pilot means, power means operative to power project and power retract said tool relative to said support, manual means operative to manually project and retract said pilot means relative to said support, and control means for said power means operatively associated with said manual means for actuating said power means to project said tool means responsive to projection of said pilot means from a retracted position past a first projected position thereof to a second further projected position thereof and for actuating said power means to retract said tool means responsive to partial retraction of said pilot means from said second projected position to said first projected position.

12. The combination of claim 11 wherein said power means comprises a double acting fluid cylinder.

* * * * *